US006505953B1

(12) United States Patent
Dahlen

(10) Patent No.: US 6,505,953 B1
(45) Date of Patent: Jan. 14, 2003

(54) LUMINAIRE OPTICAL SYSTEM

(75) Inventor: Kevin S. Dahlen, Fontana, CA (US)

(73) Assignee: Genlyte Thomas Group LLC, Louisville, KY (US)

( * ) Notice: Subject to any disclaimer, the term of this patent is extended or adjusted under 35 U.S.C. 154(b) by 26 days.

(21) Appl. No.: 09/826,617

(22) Filed: Apr. 5, 2001

Related U.S. Application Data

(60) Provisional application No. 60/195,091, filed on Apr. 6, 2000.

(51) Int. Cl.[7] ..... F21S 3/00

(52) U.S. Cl. ..... 362/217; 362/224; 362/298; 362/301

(58) Field of Search ..... 362/217, 260, 362/223, 224, 225, 147, 335, 346, 297, 298, 301

(56) References Cited

U.S. PATENT DOCUMENTS

| | | | | |
|---|---|---|---|---|
| 4,388,675 A | | 6/1983 | Lewin | |
| 4,747,027 A | * | 5/1988 | Rieger | 362/217 |
| 4,939,627 A | | 7/1990 | Herst et al. | |
| 4,974,137 A | | 11/1990 | Evans, Jr. et al. | |
| 5,075,827 A | | 12/1991 | Smith | |
| 5,521,801 A | | 5/1996 | Pesau et al. | |
| 5,823,656 A | | 10/1998 | Waldmann | |
| 5,865,528 A | | 2/1999 | Compton et al. | |
| 5,884,993 A | | 3/1999 | Conn | |
| 6,042,246 A | | 3/2000 | Waldmann | |
| 6,247,828 B1 | * | 6/2001 | Herst | 362/217 |

FOREIGN PATENT DOCUMENTS

| | | |
|---|---|---|
| GB | 2 215 447 A | 9/1989 |

* cited by examiner

*Primary Examiner*—Sandra O'Shea
*Assistant Examiner*—John Anthony Ward
(74) *Attorney, Agent, or Firm*—Jeffrey A. Haeberlin; Middleton Reutlinger

(57) ABSTRACT

A luminaire optical system having a tubular lamp, a parabolic reflector assembly, a pair of kick reflector assemblies, and a housing. The parabolic reflector assembly has a pair of substantially parabolic shaped reflectors joined to form a apex along and directly under the lamp. The kick reflector assemblies are each in a spaced relationship with the parabolic reflector assembly, thereby defining openings between the parabolic reflector assembly and the kick reflector assemblies. The housing has translucent areas which are in optical communication with the lamp through the openings.

28 Claims, 8 Drawing Sheets

LUMINAIRE OPTICAL SYSTEM

CROSS-REFERENCE TO RELATED APPLICATIONS

This application claims the benefit of U.S. Provisional Application No. 60/195,091, filed Apr. 6, 2000.

BACKGROUND OF THE INVENTION

1. Field of the Invention

The present invention relates to lighting fixtures for indirect room illumination through reflection of most of the fixture's light off of the room's ceiling, but also having a small, aesthetically pleasing downward component. More particularly, this invention relates to indirect office environment fluorescent tube lighting fixtures which are mountable close to the ceiling while providing uniform illumination of the ceiling and a high efficiency fixture.

2. Description of Prior Art

With the recent proliferation of Video Display Terminals (VDTS) in the office environment, lighting designers have identified high contrast overhead lighting as a source of glare and reflection on VDT screens. Such glare and reflection is an undesirable effect which impacts worker comfort and productivity. Thus, the need has arisen for efficient low contrast illumination of the work environment.

Indirect fluorescent tube overhead lighting has been determined to be the most efficient means of illuminating a large office environment, while providing low contrast illumination of the work area. Such lighting is accomplished by positioning fluorescent tube fixtures below the plane of the ceiling and directing nearly all of the light upward toward the ceiling. The light is then reflected off of the ceiling downward toward the room. Uniform illumination of the ceiling will provide low contrast lighting.

Additionally, designers have found that eliminating glare does not in itself result in a pleasant environment. An appropriate perceived brightness has been found to be necessary to create comfort and a sense of well-being. Thus, lighting designers have recently indicated an preference for aesthetic, low illumination of the fixture housing when viewed from the working area of the room.

Indirect fluorescent tube overhead lighting fixtures of the current art often must be suspended a significant distance below the plane of the ceiling in order to obtain a uniform light pattern while maintaining an efficient light fixture. This phenomena is due to the fact that the optical reflector systems in such fixtures of the current art distribute light output toward the ceiling at high angles (angles much greater than 105 degrees as measured from nadir). A problem, however, with mounting the fixtures a significant distance below the ceiling is that a 'false ceiling' impression is created by the rows of fixtures needed to illuminate a large work area. For instance, when looking out across a room containing multiple rows of suspended fixtures, the rows of fixtures themselves form a plane of fixtures at the suspension distance below the plane of the ceiling. In a room with 9 or 10 foot ceilings, a suspension distance of 24 to 36 inches will create an uncomfortably low false ceiling.

In order to address this problem, the light fixtures must be mounted closer to the ceiling. However, mounting fixtures with high angle light distribution close to the ceiling necessitates that the rows of fixtures be located closer to one another in order to achieve uniform illumination of the ceiling, increasing the number of fixture and the cost to illuminate the room.

Previous efforts to design fixtures with lower angles of light distribution have resulted in less efficient fixtures.

Additionally, efforts to design fixtures having illuminated housings when viewed from below have also resulted in less efficient fixtures.

SUMMARY OF THE INVENTION

It is an object of the present invention to provide an indirect fluorescent tube overhead lighting fixture with an optical system distributing light at low angles while maintaining a high efficiency.

It is a further object of the present invention to provide an indirect fluorescent tube overhead lighting fixture having an illuminated housing when viewed from below while maintaining a high efficiency.

These and other objects are achieved through the use of an optical system having a tubular lamp, a parabolic reflector assembly under the lamp, a pair of kick reflector assemblies on either side of the lamp and spaced from the parabolic reflector assembly creating openings, and a housing having translucent areas in optical communication with the lamp through the openings.

The parabolic reflector assembly may have a pair of substantially parabolic shaped reflectors joined to form an apex in a vertical plane defined by the apex and the longitudinal axis of the tubular lamp. The parabolic shaped reflectors may be symmetric about the vertical plane. The parabolic reflectors may each have a proximate edge along the apex and a distal edge opposite to the proximate edge. Further, the parabolic reflector distal edges and the tubular lamp longitudinal axis may be positioned to define planes intersecting the vertical plane at substantially 60 degrees on either side of the vertical plane.

The substantially parabolic shaped reflectors may also be comprised or approximated by at least two arc segments.

Each kick reflector assembly may be symmetric with the other about the lamp axis vertical plane, and may have a substantially vertical section which lies in a plane which is upwardly and outwardly diverging from the lamp axis vertical plane. Additionally, each kick reflector assembly may further have a horizontal section extending inwardly from the substantially vertical section and having a proximate edge located along the opening between the kick reflector assembly and the parabolic reflector assembly. Further, the kick reflector assembly horizontal section proximate edges and the tubular lamp longitudinal axis may be positioned to define planes intersecting the vertical plane at substantially 73 degrees on either side of the vertical plane.

DESCRIPTION OF THE PREFERRED EMBODIMENT

Figure 1:
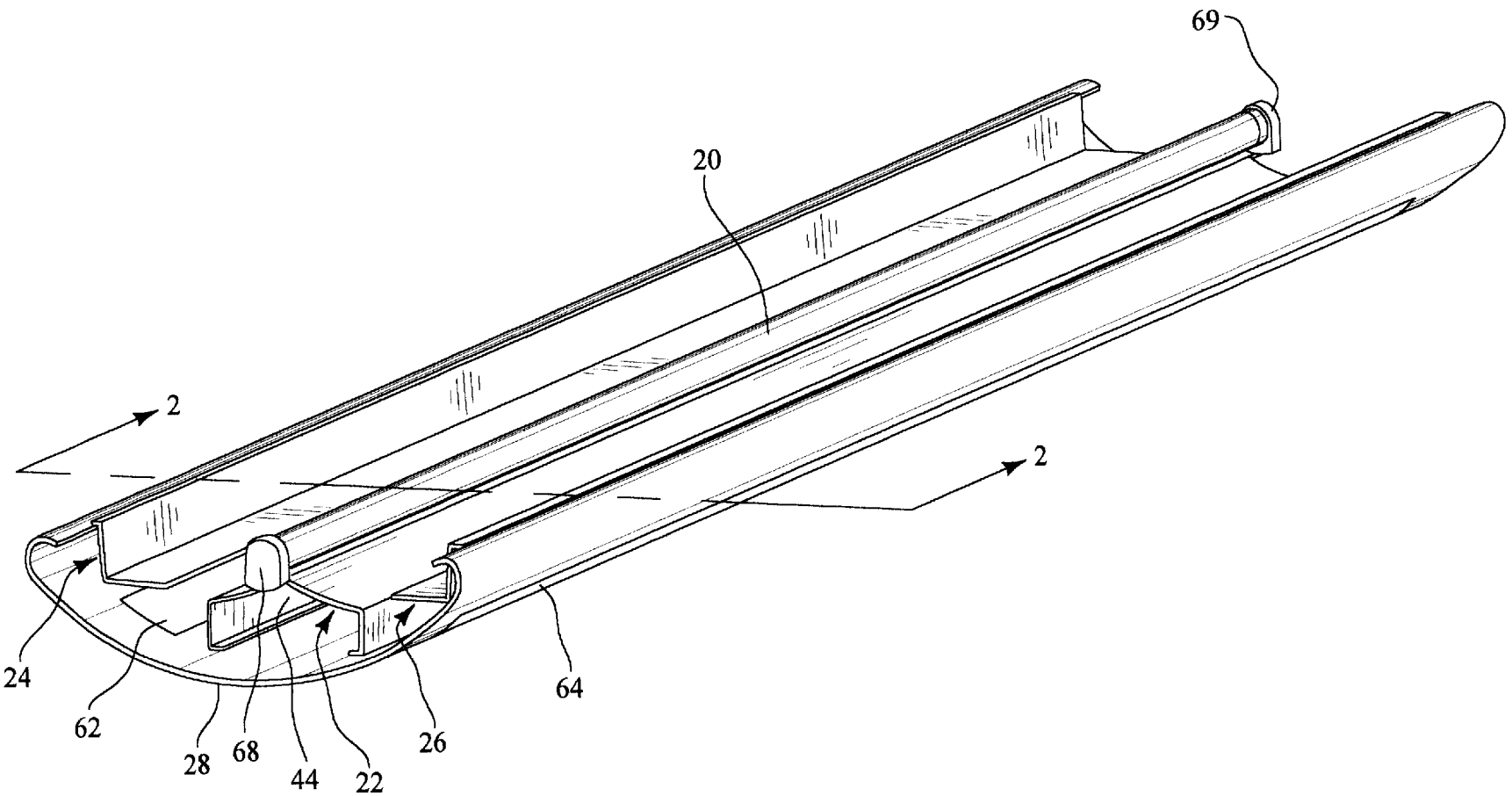
FIG. 1 shows a perspective view of a luminaire optical system of a preferred embodiment of the present invention.
Figure 2:
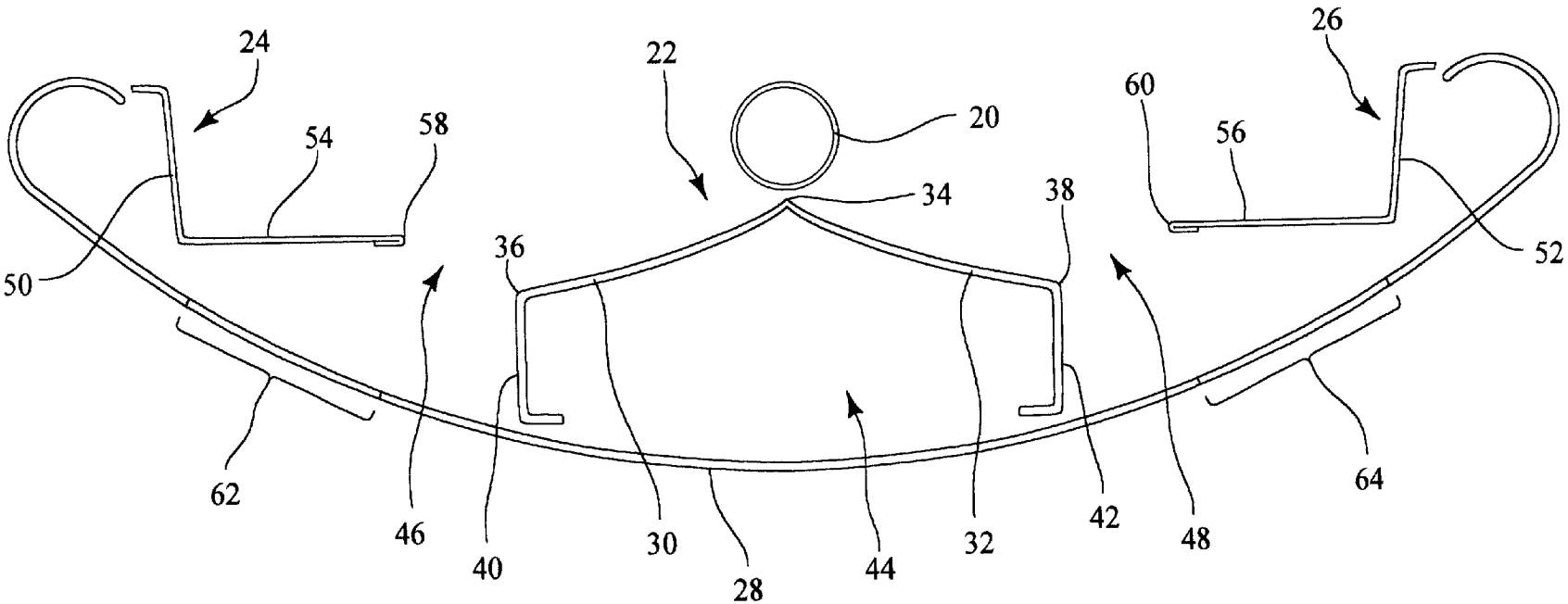
FIG. 2 shows a sectional view of the system taken along the line 2—2 of FIG. 1.

As shown in FIGS. 1 and 2, the luminaire optical system of the preferred embodiment of the invention comprises a tubular lamp 20, a parabolic reflector assembly 22, a pair of kick reflector assemblies 24, 26 and a housing 28.

The tubular lamp 20 of the preferred embodiment may be a 54-watt T5 high output type fluorescent lamp, but one skilled in the art will recognize that the benefits of the optical system of the invention will be realized with any tubular lamp.

As shown in FIG. 2, the parabolic reflector assembly 22 has a pair of substantially parabolic shaped reflectors 30, 32 located beneath the lamp 20. The parabolic shaped reflectors 30, 32 are joined to form an apex 34 along and directly under the lamp 20, with the apex 34 lying in a vertical plane which passes through the longitudinal axis of the lamp 20. The parabolic shaped reflectors 30, 32 are symmetric with each other about the lamp axis vertical plane. Thus, a proximate edge of each parabolic reflector 30, 32 is located along the apex 34. Distal edges 36, 38 are located opposite to the proximate edges.

Figure 2A:
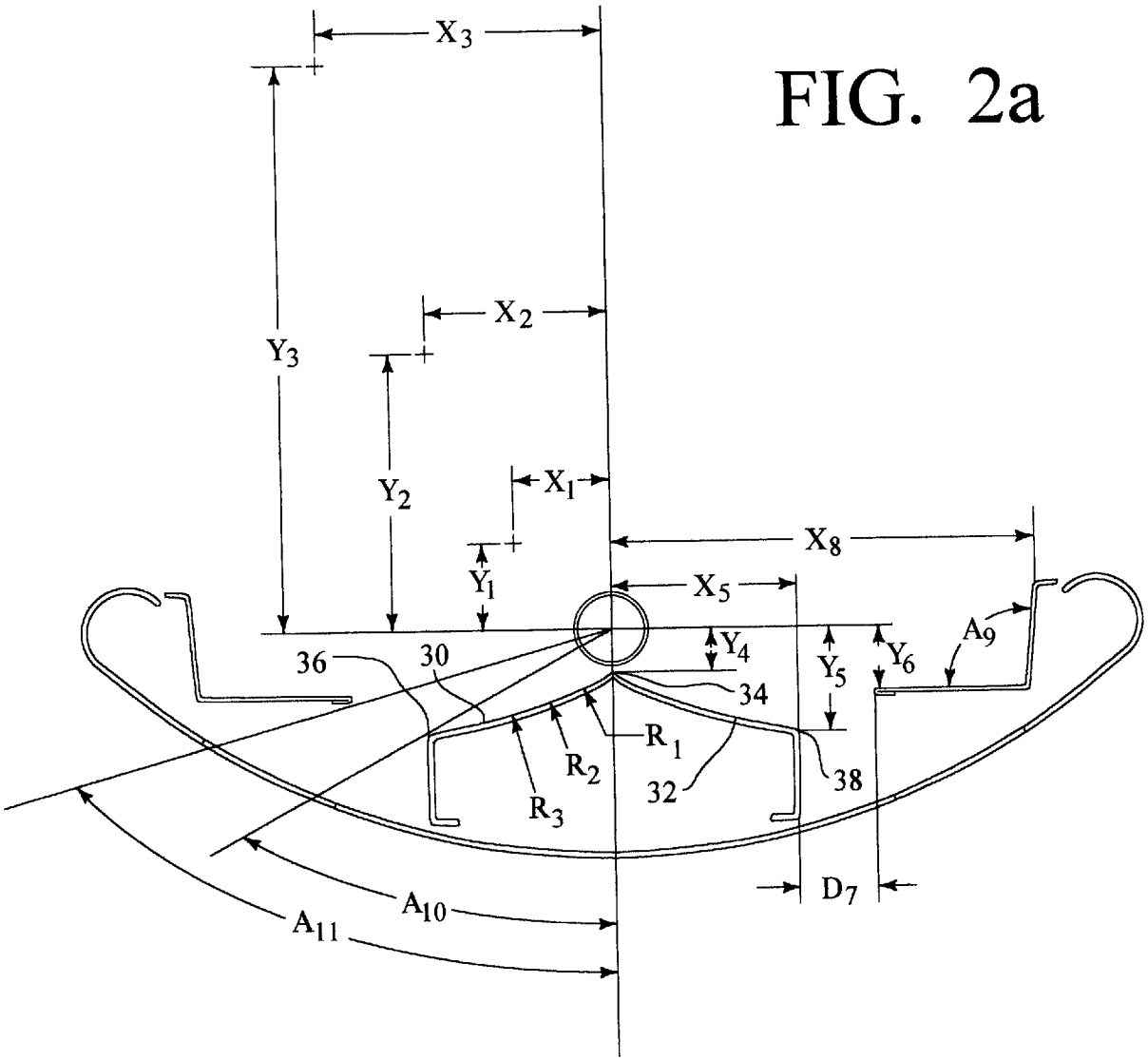
FIG. 2*a* shows the sectional view of FIG. 2 with dimensional references.

Important dimensions of the preferred embodiment of the luminaire optical system of the present invention are shown in FIG. 2*a*, and may approximate the following values:

| | | | |
|---|---|---|---|
| $X_1$ | 0.837" | $Y_4$ | 0.370" |
| $Y_1$ | 0.778" | $X_5$ | 1.577" |
| $R_1$ | 1.411" | $Y_5$ | 0.877" |
| $X_2$ | 1.577" | $Y_6$ | 0.648" |
| $Y_2$ | 2.369" | $D_7$ | 0.587" |
| $R_2$ | 3.165" | $X_8$ | 3.595" |
| $X_3$ | 2.455" | $A_9$ | 95° |
| $Y_3$ | 4.98O" | $A_{10}$ | 60° |
| $R_3$ | 5.924" | $A_{11}$ | 73° |

As shown in FIG. 2*a*, the apex 32 is located 0.370" beneath the longitudinal axis of the lamp 20. Since the lamp of the preferred embodiment shown in FIG. 2*a* is a T5 type lamp, having a diameter of about ⅝" (0.625"), or a radius of about 5/16" (0.3125"), the apex 32 is located only approximately 0.0575" beneath the bottom of the lamp 20.

As further shown FIG. 2*a*, the parabolic shaped reflector distal edges 36, 38 and the longitudinal axis of the tubular lamp 20 define planes intersecting the lamp axis vertical plane at substantially 60 degrees $A_{10}$ on either side of the vertical plane.

For ease of manufacturing, the substantially parabolic shaped reflectors 30, 32 of the instant invention may be approximated by combining two or more arc segments together. For instance, as shown in FIG. 2, the substantially parabolic shaped reflectors 30, 32 of the preferred embodiment are approximated by three arc segments of increasing radii, $R_1$, $R_2$, and $R_3$, having arc centers of $X_1$, $Y_1$; $X_2$, $Y_2$; and $X_3$, $Y_3$, respectively.

Figure 3:
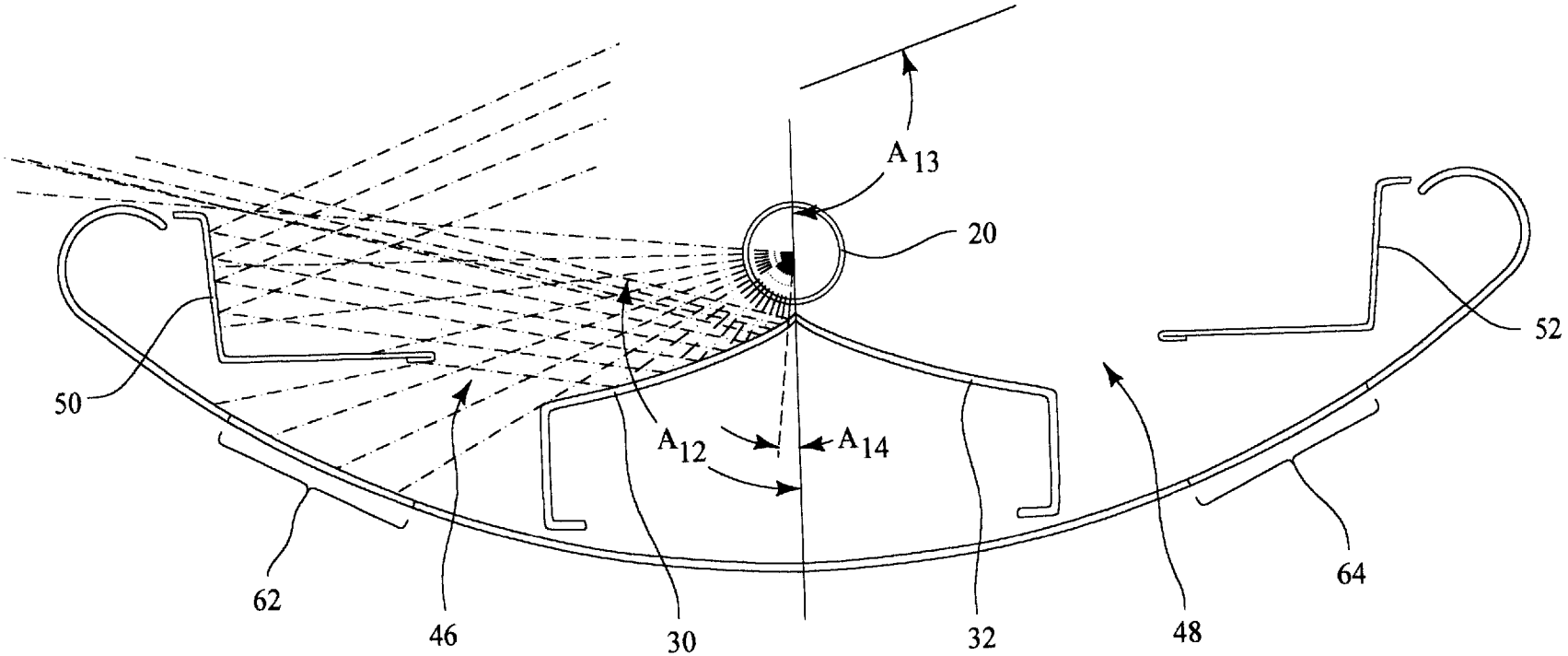
FIG. 3 shows the sectional view of FIG. 2 with a ray trace diagram of light emanating from a lower quadrant of a tubular lamp superimposed thereon.

Specifically, as shown in FIG. 3, the arrangement of the parabolic reflectors 30, 32 redirects light from the underside of the lamp upward and outward from the fixture at low angles. Thus, light emitted from the bottom half of the lamp is collected by the parabolic shaped reflectors 30, 32 and focused out of the fixture at relatively low angles toward the ceiling. For example, as shown in FIG. 3, a light ray exiting the lamp at an angle represented by $A_{14}$, which is about 7°, is reflected off of the top portion of the parabolic shaped reflector 30 and exits the fixture at an angle represented by $A_{12}$, which is about 105°. This results in efficient and effective use of light that would otherwise have been reflected back into the lamp or out of the fixture at undesirable angles.

It is important to note that, while FIG. 3 shows light emanating from the axis of the lamp, in actuality the light from a fluorescent lamp, such as in the preferred embodiment, radiates from the surface of the tube. However, the representation shown in FIG. 3 is an adequate approximation for the purpose of this description.

Returning to FIG. 2, the parabolic reflector assembly of the preferred embodiment of the invention also has vertical sections 40, 42 depending from the parabolic reflectors 30, 32 (respectively) which, together with the housing 28 define a channel 44 which runs the length of the fixture in which the ballast, wiring and other electrical components (not shown) for the fixture may be located.

Also shown in FIG. 2, the kick reflector assemblies 24, 26 are each in a spaced relationship with the parabolic reflector assembly 22, thereby defining openings 46, 48 between the parabolic reflector assembly 22 and the kick reflector assemblies 24, 26. Housing 28 has translucent areas 62, 64 which are in optical communication with the lamp 20 through the openings 46, 48.

Preferably, the kick reflector assemblies 24, 26 are symmetric with each other about the above-described vertical plane through the axis of the tubular lamp 20 and have substantially vertical sections 50, 52 which lie in planes which are upwardly and outwardly diverging from the lamp axis vertical plane.

Also, as shown in FIG. 2, the kick reflector assemblies 24, 26 of the preferred embodiment of the invention each further have a horizontal section 54, 56 extending inwardly from the base of the substantially vertical sections 50, 52. The horizontal sections 54, 56 each have a proximate edge 58, 60 along the openings 46, 48.

As shown in FIG. 3, this orientation in the preferred embodiment allows the substantially vertical sections 50, 52 to catch the light directed outward from each side of the lamp 20, along with light reflected off of the horizontal sections 54, 56 and a portion of the light directed from the parabolic shaped reflectors 30, 32, and redirect it around the lamp 20 and out of the fixture at relatively low angles. For example, the angle $A_{13}$ may be about 109°.

As shown in FIG. 2*a*, the horizontal section proximate edges 58, 60 of the preferred embodiment of the invention and the longitudinal axis of the tubular lamp define planes which intersect the lamp axis vertical plane at substantially 73 degrees $A_{11}$ on either side of the vertical plane.

Thus, as shown in FIG. 3, the openings 46, 48 allow illumination from the underside of the lamp substantially in the range from 60 degrees to 73 degrees on either side of the lamp to reach the housing translucent areas 62, 64. This small amount of light is allowed to "bleed" through to illuminate the translucent areas 62, 64 of the housing 28 rather that be reflected upward toward the ceiling. Thus, the arrangement of the reflectors of this fixture allows for an aesthetically pleasing illumination of the housing 28 while still maintaining a very high overall fixture efficiency.

Figure 5:
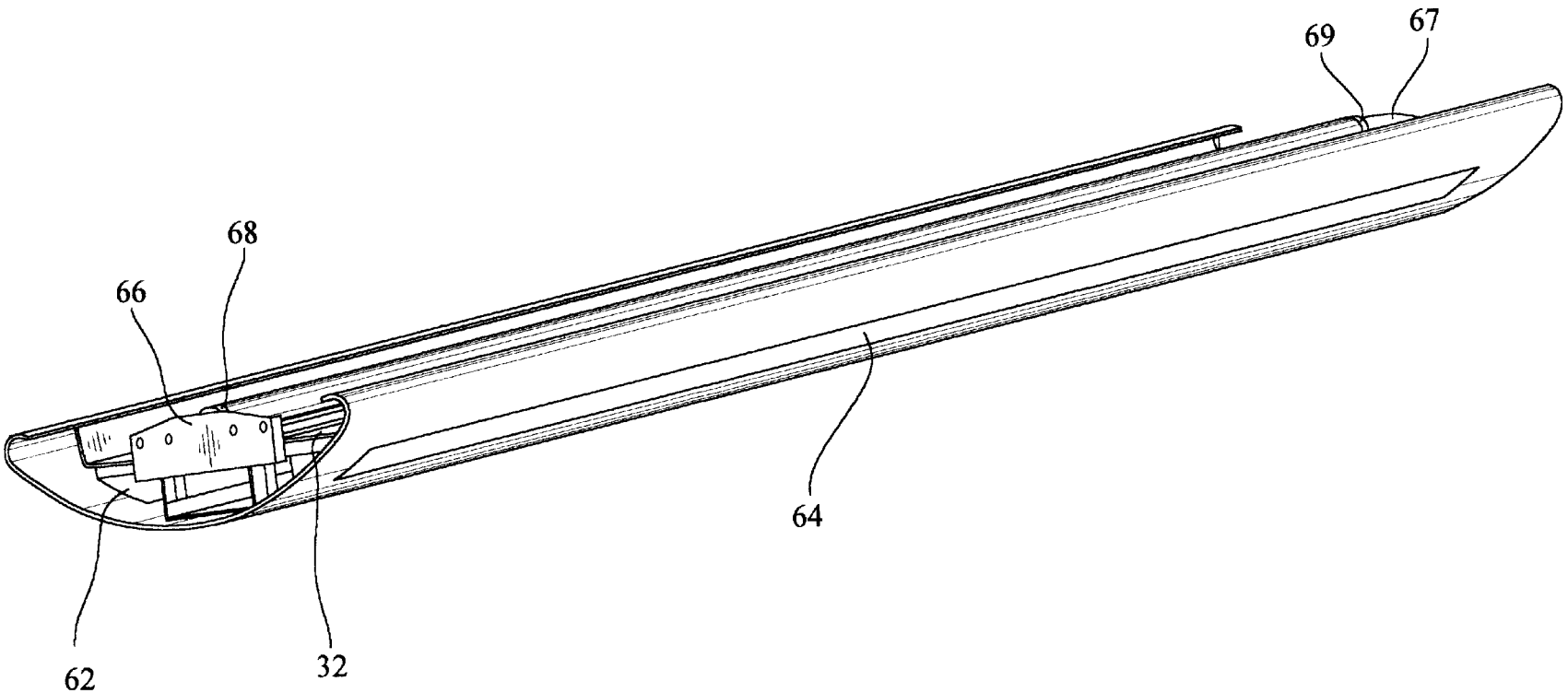
FIG. 5 shows a perspective view of the luminaire optical system of FIG. 1 with the components attached together by a bracket assembly.
Figure 7:
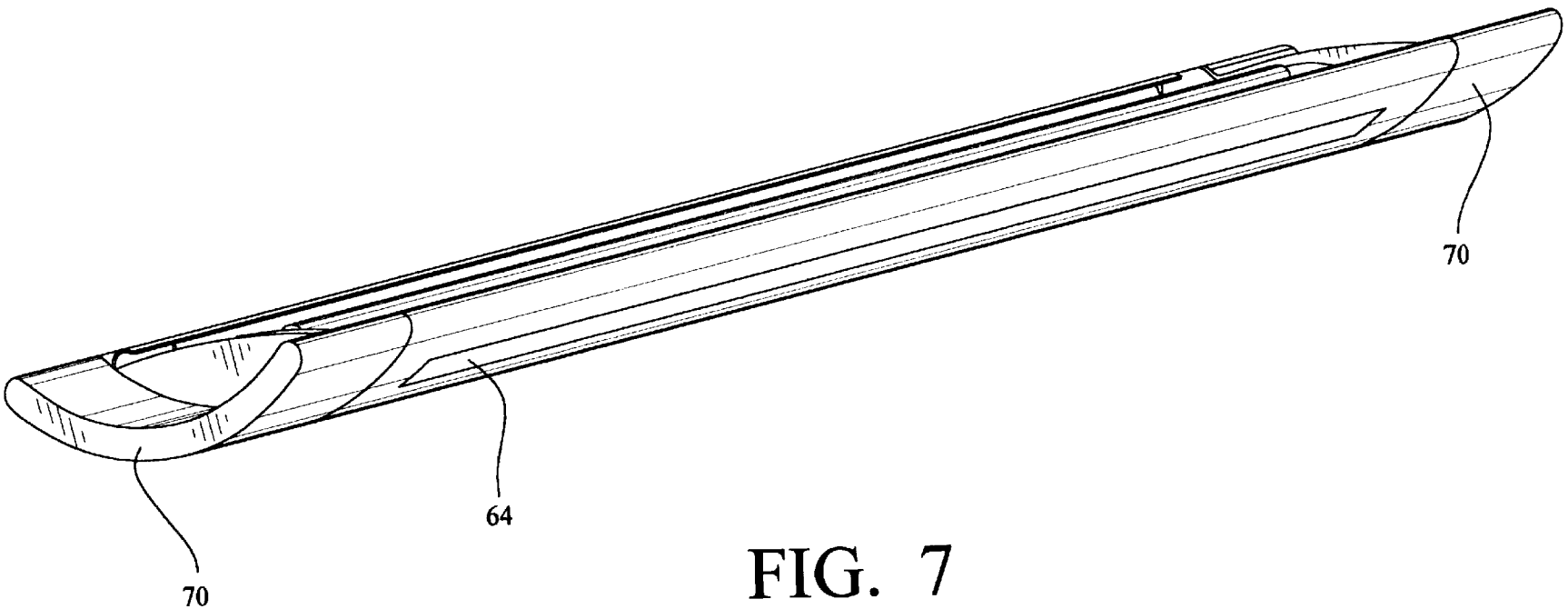
FIG. 7 shows a fully assembled light fixture, including end caps, containing the luminaire optical system of FIG. 1.

In the preferred embodiment, the translucent areas 62, 64 are formed by an acrylic translucent diffuser material in conjunction with perforating or piercing the housing material, which is preferably an 18 gauge steel. One of the translucent areas 64 is shown in FIGS. 5 and 7, also.

Further, in the preferred embodiment as shown in FIG. 2, the kick reflector assembly horizontal sections 54, 56 are positioned slightly higher than the elevation of the parabolic shaped reflector distal edges 36, 38. Thus, as shown in FIG. 3, a small portion of the light reflecting off of the parabolic shaped reflectors 30, 32 will strike the underside of the kick reflector assembly horizontal sections 54, 56 and be reflected downward toward the housing translucent areas 62, 64.

All surfaces of the parabolic reflector assembly 22 and the kick reflector assemblies 24, 26 having direct exposure to the tubular lamp 20 are finished to be to some degree reflective to light. In the preferred embodiment, these surfaces have a semi-specular finish. Additionally, the underside of kick reflector assembly horizontal sections 54, 56 as well as the parabolic reflector assembly vertical sections 40, 42 have a semi-specular finish to further aid in the reflection of light to the housing translucent areas 62, 64.

Additionally, in the preferred embodiment, the parabolic reflector assembly 22 and the kick reflector assemblies 24, 26 are each manufactured in a unitary construction, with each assembly being formed from a single piece of material to achieve manufacturing and assembly efficiencies. However, this manufacturing and assembly technique should not be construed to limit in any way the scope of the invention disclosed and claimed herein.

Figure 6:
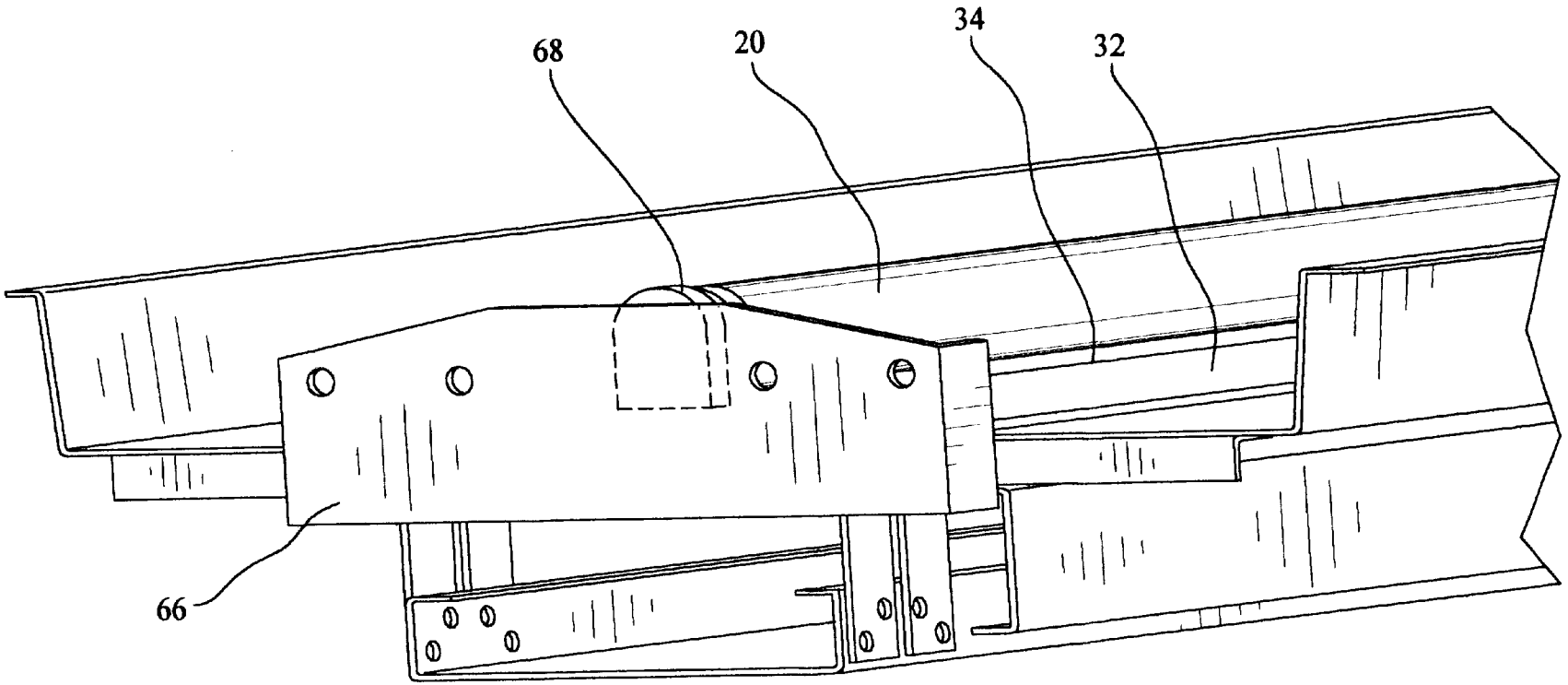
FIG. 6 shows a partial perspective view of the bracket assembly of FIG. 5.

Bracket assemblies 66, 67, shown in FIG. 5, connect the components of the optical system to form a light fixture. Thus, the bracket assemblies 66, 67 hold lamp sockets 68, 69 in position at each end of the fixture. As best shown in FIG. 6, the lamp sockets 68, 69 in turn, support the tubular lamp 20 in position just over the apex 34 of opposing parabolic reflectors 30, 32.

A fully assembled fixture may also have decorative end caps 70, shown in FIG. 7, or may be joined with other fixtures to form uninterrupted runs of fixtures (not shown).

Figure 4:
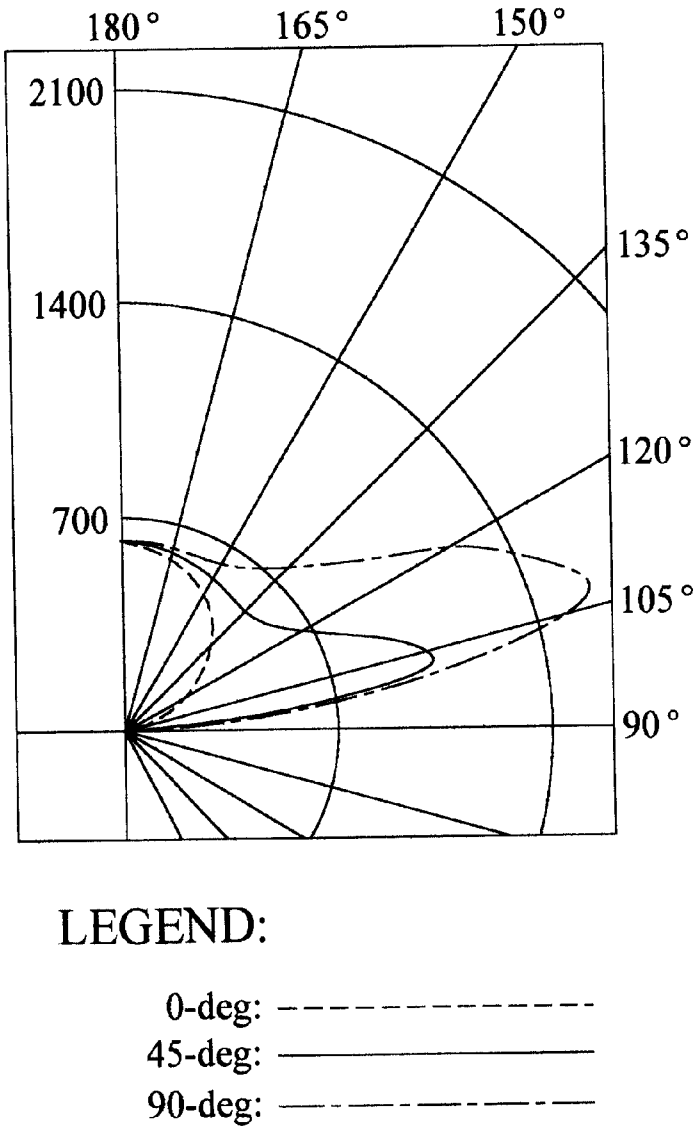
FIG. 4 is a candela distribution plot of the results of a test of the luminaire optical system of FIG. 1.

The results of photometric testing performed on the preferred embodiment described herein using a 54-watt T5 FP54W/835/HO high output linear fluorescent lamp rated at 5000 lumens output are depicted in the polar plot shown in FIG. 4. Said testing indicated peak output of 1605 candela at 107.5 degrees while demonstrating an overall fixture efficiency of 86.9%. Further testing of the preferred embodiment described herein with fixtures mounted 12 inches below the ceiling and spaced 12 foot on centers produced an approximately 6:1 luminance ratio at the surface of the ceiling. Additional testing of the closest known competitor indicated a 9:1 luminance ratio under the same conditions.

The arrangement of parabolic reflectors 30, 32 and kick reflectors 50, 52 in conjunction with the housing 28, housing translucent portions 62, 64, and a tubular lamp 20, creates a very efficient fixture having high candela output at very low angles. Thus, the fixture may be mounted close to the ceiling of a room while still providing an efficient uniform illumination of the ceiling.

The detail description of the preferred embodiment contained hereinabove shall not be construed as a limitation of the following claims, as it will be readily apparent to those skilled in the art that design choices may be made changing the configuration of the optical system without departing from the spirit or scope of the claimed invention.

What is claimed is:

1. A luminaire optical system for an indirect light fixture comprising:

a tubular lamp;

a parabolic reflector assembly located under said lamp;

a pair of kick reflector assemblies located on either side of said lamp, each said kick reflector assembly being in spaced relation with said parabolic reflector assembly, whereby openings are defined between the parabolic reflector assembly and each kick reflector assembly; and a housing beneath said parabolic reflector assembly and said pair of kick reflector assemblies, said housing having translucent areas in optical communication with said lamp through said openings, said housing defining an open top to said luminaire optical system.

2. The luminaire optical system of claim 1 wherein said parabolic reflector assembly comprises a pair of substantially parabolic shaped reflectors, said parabolic reflectors being joined to form an apex which is parallel to and radially spaced from the longitudinal axis of said tubular lamp, whereby said apex and said tubular lamp longitudinal axis define a first plane.

3. The luminaire optical system of claim 2 wherein said apex is positioned such that said first plane has a vertical orientation.

4. The luminaire optical system of claim 3 wherein said parabolic shaped reflectors are symmetric with each other about said first plane.

5. The luminaire optical system of claim 4 wherein each said parabolic shaped reflector has a distal edge opposite said apex, said distal edges and said tubular lamp longitudinal axis defining planes intersecting said first plane at substantially 60 degrees on either side of said first plane.

6. The luminaire optical system of claim 2 wherein said kick reflector assemblies are symmetric with each other about said first plane.

7. The luminaire optical system of claim 6 wherein each of said kick reflector assemblies has a substantially vertical section which lies in a plane which is upwardly and outwardly diverging from said first plane.

8. The luminaire optical system of claim 7 wherein each of said kick reflector assemblies further has a horizontal section extending inwardly from said substantially vertical section.

9. The luminaire optical system of claim 8 wherein said kick reflector horizontal section proximate edges and said tubular lamp longitudinal axis define planes intersecting said first plane at substantially 73 degrees on either side of said first plane.

10. The luminaire optical system of claim 1 wherein said housing translucent areas are perforated sections of the housing having an acrylic translucent diffuser material.

11. The luminaire optical system of claim 1 wherein said housing translucent areas are pierced sections of the housing having an acrylic translucent diffuser material.

12. The luminaire optical system of claim 1 wherein said housing is substantially concave shaped.

13. The luminaire optical system of claim 2 wherein said substantially parabolic shaped reflectors are comprised of at least two arc segments.

14. The luminaire optical system of claim 2 wherein said apex is located 0.1 inches or less beneath said tubular lamp.

15. A luminaire optical system for an indirect light fixture comprising:

a tubular lamp;

a parabolic reflector assembly having;

a pair of substantially parabolic shaped reflectors located beneath said lamp, said parabolic reflectors being joined to form an apex in a vertical plane defined by said apex and the longitudinal axis of said tubular lamp, said parabolic shaped reflectors being symmetric about said vertical plane, each of said parabolic shaped reflectors having a proximate edge along said apex and a distal edge opposite said proximate edge;

a pair of kick reflector assemblies symmetric with each other about said vertical plane, each kick reflector assembly being in spaced relation with said parabolic reflector assembly whereby openings are formed between said parabolic reflector assembly and each said kick reflector assembly, each kick reflector assembly having:

a substantially vertical section lying in a plane which is upwardly and outwardly diverging from said vertical plane; and a horizontal section extending inwardly from said substantially vertical section toward said tubular lamp, each said horizontal section having a proximate edge opposite a distal edge along said substantially vertical section;

a housing beneath said parabolic reflector assembly and said pair of kick reflector assemblies, said housing having translucent areas in direct optical communication with said lamp through said openings, said housing defining an open top to said luminaire optical system.

16. The luminaire optical system of claim 15 wherein said tubular lamp is a high output T5 type fluorescent lamp.

17. The luminaire optical system of claim 15 wherein said parabolic shaped reflector distal edges and said tubular lamp longitudinal axis define planes intersecting said vertical plane at substantially 60 degrees on either side of said vertical plane.

18. The luminaire optical system of claim 15 wherein said substantially parabolic shaped reflectors are comprised of at least two arc segments.

19. The luminaire optical system of claim 15 wherein said apex is located 0.1 inches or less beneath said tubular lamp.

20. The luminaire optical system of claim 15 wherein said substantially vertical section forms a 95 degree angle with said horizontal section.

21. The luminaire optical system of claim 15 wherein said kick reflector horizontal section proximate edges and said tubular lamp longitudinal axis define planes intersecting said lamp axis vertical plane at substantially 73 degrees on either side of said vertical plane.

22. The luminaire optical system of claim 21, said kick reflector horizontal sections further having a bottom reflecting surface, said kick reflector horizontal sections being positioned higher than the elevation of said parabolic reflector distal edges.

23. The luminaire optical system of claim 15 wherein said housing translucent areas are perforated sections of the housing having an acrylic translucent diffuser material.

24. The luminaire optical system of claim 15 wherein said housing translucent areas are pierced sections of the housing having an acrylic translucent diffuser material.

25. An indirect luminaire comprising:

a first and a second lamp socket defining a longitudinal axis therebetween;

a first parabolic reflector extending below said longitudinal axis;

a first kick reflector located on a first side of said longitudinal axis, said first kick reflector having a flat, substantially vertical reflective surface; and a housing under said first parabolic reflector and said first kick reflector, said housing defining an open top of said indirect luminaire.

26. The indirect luminaire of claim 25 further comprising a second parabolic reflector extending below said longitudinal axis, said second parabolic reflector and said first parabolic reflector being joined to form an apex in a vertical plane defined by said apex and said longitudinal axis.

27. The indirect luminaire of claim 26 further comprising a second kick reflector located on a second side of said longitudinal axis, said second kick reflector having a flat, substantially vertical reflective surface.

28. The indirect luminaire of claim 25 wherein said first parabolic reflector and said first kick reflector are in a spaced relationship whereby an opening is formed between said first parabolic reflector and said first kick reflector, said housing further having a translucent area in optical communication with said longitudinal axis through said opening.

* * * * *